United States Patent [19]

Nobileau

[11] 4,228,857

[45] Oct. 21, 1980

[54] FLOATING PLATFORM WELL PRODUCTION APPARATUS

[75] Inventor: Philippe C. Nobileau, Oxnard, Calif.

[73] Assignee: Vetco Inc., Ventura, Calif.

[21] Appl. No.: 968,648

[22] Filed: Dec. 11, 1978

[51] Int. Cl.[3] ..... E21B 7/12

[52] U.S. Cl. ..... 166/341; 166/363; 166/366; 175/7

[58] Field of Search ..... 166/341, 366, 364, 339, 166/350, 359, 363; 405/227; 175/7, 8, 9

[56] References Cited

U.S. PATENT DOCUMENTS

| | | | |
|---|---|---|---|
| 3,670,515 | 6/1972 | Lloyd | 175/9 X |
| 3,677,016 | 7/1972 | Garrigus | 175/9 |
| 3,789,921 | 2/1974 | DeChassy et al. | 175/9 |
| 4,098,333 | 7/1978 | Wells et al. | 175/7 |
| 4,119,145 | 10/1978 | Tuson | 166/339 |
| 4,126,183 | 11/1978 | Walker | 166/364 X |
| 4,142,584 | 3/1979 | Brewer et al. | 166/364 X |

*Primary Examiner*—James A. Leppink
*Assistant Examiner*—Richard E. Favreau
*Attorney, Agent, or Firm*—Edward L. Kochey, Jr.

[57] ABSTRACT

A plurality of wells are clustered around a central riser which is maintained under tension from a floating platform. A plurality of spiders on the riser carry funnels in vertical alignment with the wells. The funnels are sufficiently large to permit the passage of wellhead connectors and master block valves, and the production risers include centralizers which brace the production riser from the funnels through a limited vertical range. Tensioning of the production riser is with a lower force and through a limited range which precludes disengagement of the centralizers from the funnel. Some centralizers are located to facilitate entry and attachment to the wellhead.

12 Claims, 5 Drawing Figures

FLOATING PLATFORM WELL PRODUCTION APPARATUS

BACKGROUND OF THE INVENTION

This invention relates to oil production, to a floating platform and in particular to a production riser arrangement.

In the production of oil from subsea wells, it is required that the oil be conveyed to the surface, depressurized and degased before it can be pumped for delivery. When a floating production platform is used, it is required that the system include capabilities for disconnecting in emergencies, and the risers passing to the surface must be tensioned to avoid excess stresses caused by loading and ocean currents. Small diameter riser tubing is not readily adaptable to the high tensions required because of its low metal section and because of the high internal pressures existing in the absence of a production choke (throttling valve) at the ocean floor.

Accordingly, prior art multiple well production has included a subsea template incorporating plumbing and control connections for the several wells. It includes subsea trees for each well and a subsea manifold to manifold annulus access and purge riser. A production riser is required to separately transfer oil coming from each well and to provide a common annulus access. Work over risers must be run to perform wire line and tree retrieval operations.

Such a system requires for each well at least five subsea connections between the tubing hanger and the surface and four subsea connections on each control line for straight hydraulic control. It requires the subsea manifold. Several trips are needed to reestablish guidelines for the purpose of servicing a well. The work over riser needs an additional moon pool on the floating platform with additional lifting capabilities.

A floating production facility is described in a paper presented at the 1977 Offshore Technology Conference entitled, "First Floating Production Facility-Argyll," by Messrs. Hammett and Johnson (OTC 2821). The paper describes a multiple well production facility where the various wells are connected to a subsea manifold with the production risers from the wells passing upwardly in annularly-spaced relationship with a central riser. Production trees are located at the wellhead of the vaious wells with reduced-pressure oil being transferred to the subsea manifold. The same paper also suggests the possibility of cluster well drilling, a plurality of wells surrounding the central riser. Production trees are located at each of the wellheads, but their removal requires that the risers are pulled out.

SUMMARY OF THE INVENTION

A cluster well production apparatus for a floating platform includes a central large diameter riser which may be used to pump the produced oil to the sea floor for delivery elsewhere. High tension force is maintained on this riser which includes a remote operated connector and a flexible joint which allows for some movement of the floating platform. Production risers from a plurality of wellheads located around the central riser pass directly up from the wellhead and are braced at selected elevations by a spider connected to the central riser. The spider supports funnels in spaced relationship therefrom for the purpose of guiding and horizontally restraining the production risers.

The production risers include centralizers at the spider elevations which fit closely within the funnels for the purpose of bracing these relatively small production risers. The use of these centralizers permits the funnels to be of sufficient size to pass wellhead connectors and master valve blocks. Accordingly, the master valves are retrievable, and permanent vertical access is available at all times through the production risers, which also act as the master valve retrieving tool.

Emergency riser disconnections can be performed without losing the lateral bracing of the spiders because of the tensioning arrangements used. The central riser is tensioned with substantial force to generate the required stiffness and uses high travel tensioners which will compensate for tide and swell. Limited stroke tensioners apply lesser forces to the production risers from an upper tensioning platform which is carried by the central riser. These tensioners need only take the range of differential movement due to bending of the riser system. The length of engagement between the funnels and the cones is established so that they will not come out of engagement despite full travel of these production riser tensioners.

Spiders and/or centralizers at the lower elevations are omitted to provide an unrestrained length for the production risers to bend as the central riser bends about its flexible connection. The spiders may be supplied at these elevations with centralizers located such that they are out of engagement when the production riser is in its connected position. These centralizers are located so that they will be engaged as the production riser approaches its connection so as to guide the production riser into the final guide funnel just prior to connection.

DESCRIPTION OF THE PREFERRED EMBODIMENT

Figure 1:
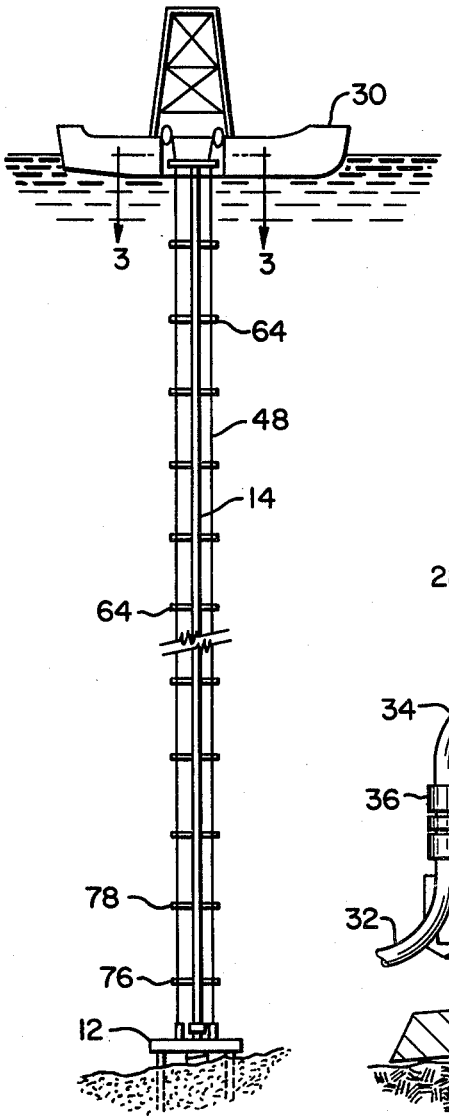
FIG. 1 is a general arrangement illustrating the relationship between the risers, the spiders, the floating platform, and the wellheads.
Figure 2:
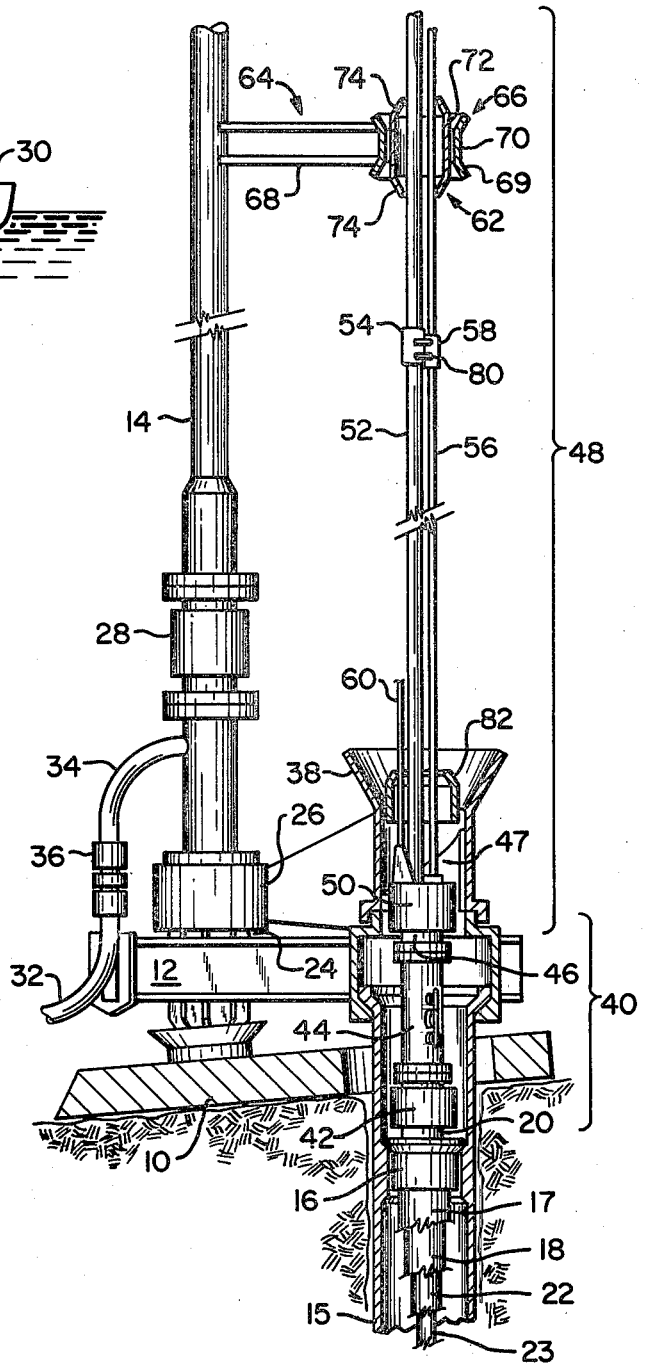
FIG. 2 is an elevation through the wellhead area, also illustrating the relationship between the guide funnel and the cones at the upper elevations.

The drawings illustrate the invention during the production phase. During the drilling phase a temporary guide base 10 is set on the ocean floor with a two post five-well template 12 installed thereon. This template is set in a level position and anchored with a 30-inch anchoring pile. It is run on the central riser 14, having a vertical axis, and is set with openings located on about a 6-foot radius from the centerline for each of the five wells to be drilled.

A reusable guide base (not shown) is lowered and latched onto the template to provide guidance and support for drilling of one of the wells. Using this guide base a well is drilled in a conventional manner with the installation of a 36-inch conductor housing 15, a 20-inch casing hanger 16, a 20-inch casing 17, and a 13⅜-inch casing 18. A 13⅝-inch wellhead housing 20 is landed and cemented. After the 9⅝-inch casing 22 is landed and cemented inside the 13⅝-inch wellhead housing, the well is completed by the installation of tubing 23 and a tubing hanger as well as subsurface safety valves. Temporary plugs are placed in the tubing hanger, and the blowout prevention stack is removed.

The reusable guide base is relocated to drill one or more of the other four wells. They are similarly completed.

For the production phase the central riser 14 is connected to the anchor head 24 by the use of a remotely operated connector 26. This riser includes near its lower end a flexible joint 28 which permits up to 10° angular displacement on movement of the floating platform. This central riser is of large diameter in the order of 12 to 14 inches and is tensioned from the floating platform 30 in a manner as will be described hereinafter, for the purpose of avoiding excessive bending of the riser system.

A sales line 32 is connected to the template 12. A sales line outlet 34 located on the central riser is connected to the sales line 32 by remotely operated connector 36. Both connectors 26 and 36 may be remotely disconnected under emergency conditions. A conventional purge line may be installed on the central core above the flexible joint if desired.

The central riser and sales line as illustrated will be used for pumping the processed oil to a point of use. Should an above-the-surface means be used to discharge the produced oil, the central riser will be retained for its structural characteristics without any flow of oil therethrough.

The central riser carries a plurality of entrance guide funnels 38 vertically oriented so as to be just above the wellhead, with the central riser being axially keyed so that the various funnels 38 are in alignment with respective wells.

A compact type production block 40 is connected to the 13⅝-inch drilled wellhead housing 20. This production block is comprised of a small diameter wellhead connector 42 (32½-inches O.D.), a master block valve 44 with three-inch production bore and a two-inch annular access, and a 13⅝-inch mandrel 46. This establishes a production wellhead housing 46 in addition to the drilled wellhead housing 20. Remote disconnection of the production riser may be made from either of these locations depending on whether it is required to raise the master valve block to the surface. A camming surface 47, within the guide funnel 30 keys the connectors for proper tubing orientation.

A satellite production riser 48 is connected to the production wellhead housing 46 by wellhead connector 50. This satellite production riser 48 also includes a 3- to 6-inch cantilevered line 52 for production, with preloaded riser connectors 54, and a cantilevered line 56 for annulus access with choke and kill line type stab connections 58. It also includes a control hose bundle 60 strapped to the side of the production line for hydraulic control of the production block. The production riser also includes centralizers 62 which will be further described below.

The central riser includes at a plurality of elevations and at about 30-foot spacing spiders 64. Each spider comprises five funnels 66 which are maintained in spaced relationship from the central riser and in axial alignment with each of the wellheads by spacing arms 68. Each funnel 66 has outwardly tapered openings 69 at the top and bottom and a central straight portion 70.

The centralizers 62 are located on each of the satellite production risers, which are 34½-inches O.D., so as to be in closely spaced radial relationship with the funnels when all apparatus is in its operating position. The actual shape of the centralizer may vary, but it will generally include a straight portion 72 and a tapered portion 74 at the top and bottom. The straight portions 72 and 70 interact so that horizontal forces on the production riser 48 are restrained by the funnels and the force is transmitted to the stronger, more highly tensioned central riser 14. The vertical engagement range is that range of vertical movement of the production riser 48 with respect to the central riser 14 which will result in continued engagement of at least some portion of the corresponding vertical straight surfaces. These centralizers are omitted from the production risers at lower spiders 76 and 78 so as to provide some vertical length for flexing of the production riser as the central riser bends around its flexible connection 28. This bending produces some elevational differences throughout the lengths of the respective lines. The vertical engagement range must exceed this theoretical difference in length due to bending of the lines. The engagement range is also related to the tensioning apparatus as will be described later.

The tapered ends on the centralizers serve only to guide the centralizer within the funnels. It follows that the approach of these extended ends to the tubing itself is a function of the width of the flare on the funnels. All that is required is that as the tubing string moves down through the funnels that sufficient guidance be provided on the end of the centralizer to move it readily to within the funnel. Each centralizer is attached to at least one of the tubes of the production riser to maintain the vertical alignment. The various parallel components of each satellite production riser are preferably guided with horizontal restraint as they pass through the funnel. This is not necessary, however, if cantilevered connections 80 are provided between the components. With such a connection horizontal forces on one line are passed directly to the centralizer while horizontal forces on other lines pass through the cantilevered connections to that line which is restrained by the centralizer.

Furthermore, the centralizer need not be of bent plate material but could be formed of vertical tapered members located in a cruciform arrangement. All that is essential is that the centralizer function to restrain horizontal forces against the funnel. It must have tapered ends to permit entrance and guidance into the funnel only if the funnel flare is lses than the distance from the tubing surface to the outer centralizer surface. A relatively small flare is preferred to reduce forces on the riser due to ocean currents.

An additional conical member 82 is located on the production riser above the wellhead connector 50 for purposes of facilitating passage of the wellhead connector through the funnels when raising the line.

All of the funnels have an inside diameter of 36 inches, such that the 32½-inch O.D. wellhead connectors 50 and 42 as well as the master valve block 44 may pass through the funnels. Accordingly, the master valve block is retrievable through the guide funnels to the surface vessel. Production can be sent to the surface with only two subsea connections between the tubing hanger and the surface and only one connection for the hydraulic control line. Permanent vertical access is provided through the satellite production riser which acts as a production block riser tool as well. Furthermore, no work over is required.

Emergency disconnect of the central riser and the satellite risers may be made by opening connectors 26, 36, and 50. With appropriate arrangement of the tensioning apparatus all the satellite production risers remain braced against the central riser.

Figure 3:
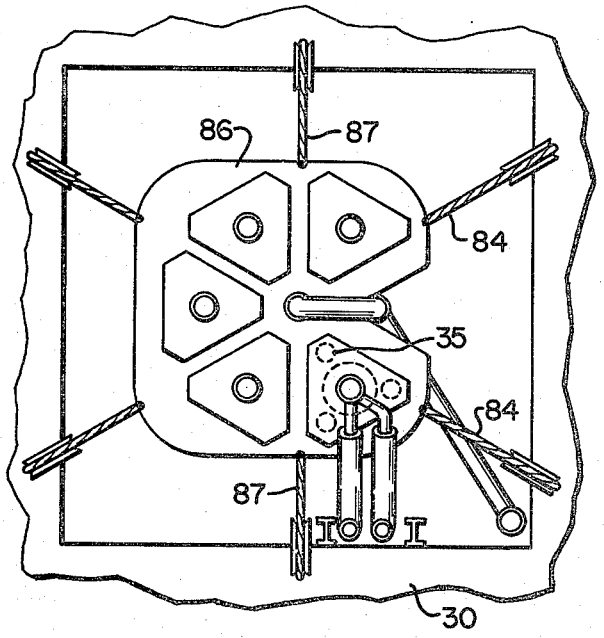
FIG. 3 is a plan view of the tensioning platform.
Figure 4:
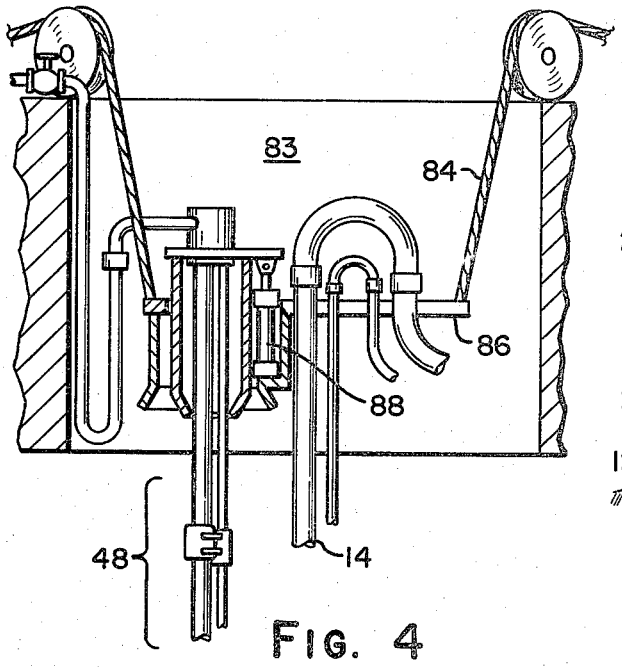
FIG. 4 is an elevation of the tensioning platform.

FIGS. 3 and 4 illustrate the arrangement of the tensioning apparatus in the moon pool 83 of the floating platform 30. Riser tensioner cables 84 operate to directly tension the tensioning platform 86 which is direclty connected to the central riser 14. This supplies the substantial tensioning force to the riser 14 which is required to avoid excessive bending of the riser assembly. These cables and this platform are also subject to extensive travel in the order of 40 feet to provide allowance for drift, tide, and wave action. Guide lines 87 are attached to the template 12 to provide guidance for connection of the central riser 14.

The satellite production risers 48 are each tensioned from the platform through hydraulic tensioner 88. These tensioners have only a limited stroke since the differential movement between the satellite risers and the central riser is only the difference in length due to bending around the expansion joints. The vertical engagement range between the centralizers 62 and the funnels 66 should exceed the full stroke of tensioner 88. In the event of a disconnect of all lines it would be expected that the tensioner 88 will run to an extreme end of the travel. By the use of the aforementioned relationship, the satellite risers will remain in engagement with the funnels through their centralizers and thereby still be restrained on the strong central riser.

Figure 5:
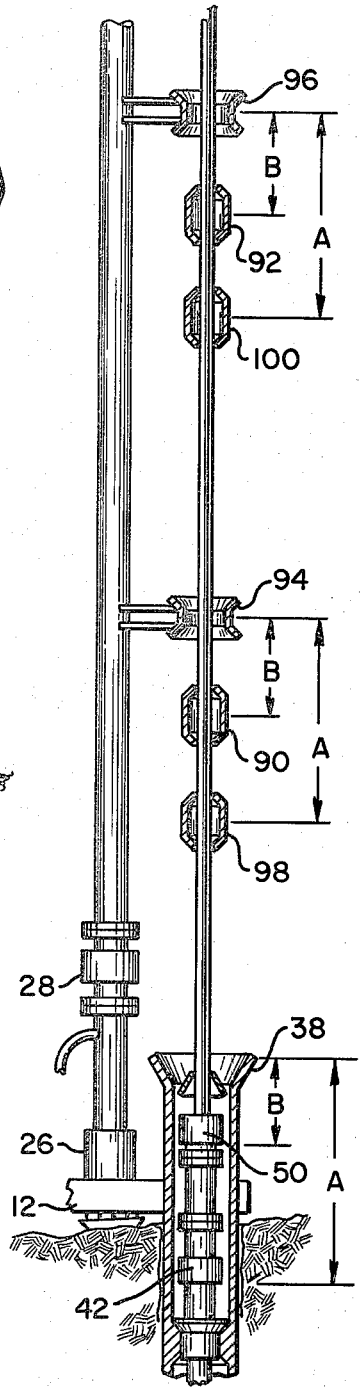
FIG. 5 is a schematic elevation view showing the relationship of the lower cones to facilitate entrance of the production riser into the guide funnel.

FIG. 5 illustrates an arrangement of funnels on the lower portion of the satellite production riser. As can be seen these centralizers are not in engagement with the funnels in their installed position. They serve to align the production riser with the inlet funnel 38 during installation. In the event of a disconnect of wellhead coupling 50 it can be seen that with the riser raised a distance B, centralizers 90 and 92 are in contact with funnels 94 and 96 respectively. At this time the wellhead connector 50 will be located just at the entrance of inlet funnel 38. Accordingly, funnels 94 and 96 will serve to align the coupling for entrance into the inlet funnel. Similarly, should the disconnection be made by connector 42 for the purpose of removing the master valve block, then dimension A would apply and centralizers 98 and 100 would interact with funnels 94 and 96 for alignment with the inlet funnel 38.

The distance from the top of the inlet funnel 38 to the lower funnel 94 is preferably selected to be a distance equal to the spacing of spiders 64 throughout the height of the riser system. With such an apparatus it can be seen that at each elevation the corresponding funnels 90 and 92 in one situation and 98 and 100 in the other will serve to align the coupling with the next succeeding funnel as the line is run downwardly from the vessel.

The invention provides an arrangement for close spacing of multiple wells with a capability for carrying out all operations on the wells from the single moon pool on a floating production platform. The production lines may be operated at high pressure with choking under normal operation accomplished by production valves on the floating platform. The risers may be operated at the high well pressures since the tensioning force need not be excessive with guidance supplied by the funnels. The wellhead connectors and the master valve block can be removed through the funnels while the funnels are still capable of supplying a restraining action with the installation of the centralizers.

What is claimed is:

1. A cluster well production apparatus for floating platform production comprising: a central large diameter riser having a vertical axis, a plurality of wellheads surrounding the vertical axis of said central riser; a plurality of spiders fastened to said central riser at selected elevations, a plurality of guide funnels on each spider secured in spaced relationship with said central riser and in axial alignment with said wellheads; a production riser running directly upwardly from each wellhead and passing through corresponding guide funnels, said production riser including a tubing string; the openings through said guide funnels being significantly larger than said tubing string; and centralizers attached to said production riser at elevations corresponding to at least some of the spider elevations and sized to be in closely-spaced relationship within said funnels.

2. An apparatus as in claim 1 wherein said production riser includes a wellhead connector; said guide funnels and wellhead connectors being sized so that the wellhead connector passes through said funnels.

3. An apparatus as in claim 2 having also entry funnels adapted to be held in axial relationship with each of said wellheads; the axial spacing between the lower edge of said wellhead connector and a lower centralizer being slightly less than the axial spacing between the majority of said centralizers.

4. An apparatus as in claim 2 having also a conical guiding means located on said production riser directly above said wellhead connector.

5. An apparatus as in claim 2 having also entry funnels adapted to be held in closely spaced relationship with each of said wellheads; centralizers located on the lower portion of said production risers at a location with respect to said spiders so as to be in closely-spaced relationship with said spiders as said wellhead approaches said entry funnel but axially remote from the guide funnels when the wellhead connector is connected to the wellhead.

6. An apparatus as in claim 5 wherein the axial spacing between the top of said entry funnel and an aligned guide funnel on the lower end of said central riser is equal to the axial spacing between the majority of said guide funnels.

7. An apparatus as in claim 1 having also a production block connected to said wellhead, said production block comprising a wellhead connector for connecting to said wellhead, a master block valve connected to said wellhead connector, and a mandrel extending upwardly from said master block valve; said production riser including at its lower end a production block connector adapted to connect to said mandrel; said production block, said production block connector, and said funnels being sized so that the production block and connector pass thru said guide funnels.

8. An apparatus as in claim 7 having also an entry funnel adapted to be held in axial spaced relationship with each of said wellheads; centralizers located on the lower portion of said production risers so as to be in closely-spaced relationship with said guide funnels as said wellhead connector and said production block connector each approach said entry funnel, but axially remote from guide funnels when the wellhead connector is connected to said wellhead.

9. An apparatus as in claim 1 having a high tension means located on said floating platform for applying tension to said central riser; and lower tension means located on said floating platform for applying tension to said production risers.

10. An apparatus as in claim 9 wherein said high tension means includes a platfrom attached to said central riser and said lower tension means are operatively connected between said platform and each of said production risers.

11. An apparatus as in claim 10 wherein said lower tension means have limited stroke capability less than the length of the vertical engagement range of said centralizers and said guide funnels.

12. An apparatus as in any one of claims 1–11 wherein each of said centralizers comprises a central vertical portion and tapered upper and lower portions.

* * * * *